US011021338B2

(12) United States Patent
Maeyama

(10) Patent No.: US 11,021,338 B2
(45) Date of Patent: Jun. 1, 2021

(54) SHEET CONVEYING DEVICE AND IMAGE FORMING APPARATUS INCORPORATING THE SHEET CONVEYING DEVICE

(71) Applicant: Yuichiro Maeyama, Kanagawa (JP)

(72) Inventor: Yuichiro Maeyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 64 days.

(21) Appl. No.: 16/297,892

(22) Filed: Mar. 11, 2019

(65) Prior Publication Data

US 2019/0283992 A1 Sep. 19, 2019

(30) Foreign Application Priority Data

Mar. 13, 2018 (JP) ..... JP2018-045716

(51) Int. Cl.
*B65H 5/22* (2006.01)
*B65H 5/06* (2006.01)
(Continued)

(52) U.S. Cl.
CPC ..... *B65H 5/226* (2013.01); *B65H 5/062* (2013.01); *B65H 7/02* (2013.01); *B65H 7/16* (2013.01);
(Continued)

(58) Field of Classification Search
CPC ..... B65H 5/22; B65H 5/222; B65H 5/226; B65H 2404/40; B65H 2406/30;
(Continued)

(56) References Cited

U.S. PATENT DOCUMENTS 6,209,867 B1 * 4/2001 Madsen ..... B41J 11/0025 271/183
9,283,789 B2 * 3/2016 Ueda ..... B41J 11/007
(Continued)

FOREIGN PATENT DOCUMENTS

JP 2010-149417 7/2010
JP 2011-168020 9/2011
(Continued)

OTHER PUBLICATIONS

U.S. Appl. No. 16/204,013, filed Nov. 29, 2018, Tomohiro Egawa, et al.

(Continued)

*Primary Examiner* — Prasad V Gokhale
(74) *Attorney, Agent, or Firm* — Harness, Dickey & Pierce, P.L.C.

(57) ABSTRACT

A sheet conveying device includes a conveying body, a pressing body, and an attracting device. The conveying body conveys a sheet. The pressing body presses the sheet to a circumferential surface of the conveying body at an upstream side from an operation start position at which an operation with respect to the sheet starts, in a sheet conveying direction. The attracting device sucks and attracts the sheet onto the conveying body. The attracting device includes an attracting unit having an attracting region extending shorter than a distance between the pressing body and the operation start position. The attracting unit rotate together with the conveying body.

20 Claims, 4 Drawing Sheets

(51) Int. Cl.
*B65H 7/16* (2006.01)
*B65H 7/02* (2006.01)

(52) U.S. Cl.
CPC ..... *B65H 2404/40* (2013.01); *B65H 2406/33* (2013.01); *B65H 2406/362* (2013.01); *B65H 2406/3632* (2013.01); *B65H 2511/12* (2013.01)

(58) Field of Classification Search
CPC ..... B65H 2406/31; B65H 2406/33; B65H 2406/331; B65H 2406/36; B65H 2406/362; B65H 2406/3622; B65H 2406/363; B65H 2406/3632; B65H 2406/351
See application file for complete search history.

(56) References Cited

U.S. PATENT DOCUMENTS

| | | | | |
|---|---|---|---|---|
| 9,796,546 | B1 * | 10/2017 | LeFevre | B41J 11/007 |
| 2009/0212494 | A1 | 8/2009 | Maeyama | |
| 2009/0266926 | A1 | 10/2009 | Yoshimaru et al. | |
| 2010/0066781 | A1 | 3/2010 | Niihara et al. | |
| 2011/0057380 | A1 | 3/2011 | Maeyama et al. | |
| 2011/0064497 | A1 | 3/2011 | Niihara et al. | |
| 2011/0157289 | A1 * | 6/2011 | Yamanobe | B41J 11/0015 347/104 |
| 2012/0068401 | A1 * | 3/2012 | Kondo | B41J 13/226 271/18.1 |
| 2012/0140011 | A1 | 6/2012 | Yamada et al. | |
| 2012/0222530 | A1 | 9/2012 | Yoshinuma et al. | |
| 2012/0222531 | A1 | 9/2012 | Ogawa et al. | |
| 2013/0240593 | A1 | 9/2013 | Maeyama | |
| 2014/0176655 | A1 * | 6/2014 | Hattori | B41J 13/08 347/104 |
| 2017/0020741 | A1 * | 1/2017 | Ingole | B65G 39/02 |
| 2017/0210578 | A1 | 7/2017 | Nakada et al. | |
| 2017/0210579 | A1 | 7/2017 | Watanabe et al. | |
| 2018/0016106 | A1 * | 1/2018 | Asada | B65H 29/245 |
| 2018/0178551 | A1 * | 6/2018 | Ziegenbalg | B65H 9/105 |

FOREIGN PATENT DOCUMENTS

| | | |
|---|---|---|
| JP | 2011-173713 | 9/2011 |
| JP | 2012-020870 | 2/2012 |
| JP | 2017-222088 | 12/2017 |

OTHER PUBLICATIONS

U.S. Appl. No. 16/205,493, filed Nov. 30, 2018, Yuichiro Maeyama, et al.

* cited by examiner

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2018-045716, filed on Mar. 13, 2018, in the Japan Patent Office, the entire disclosure of which is hereby incorporated by reference herein.

BACKGROUND

Technical Field

This disclosure relates to a sheet conveying device, and an image forming apparatus incorporating the sheet conveying device.

Related Art

Image forming apparatuses include printing apparatuses that print a sheet while winding the sheet around a conveying drum as the sheet is conveyed. In such printing apparatuses, the sheet is to be gripped by the conveying drum on the circumferential surface of the conveying drum without crease on the sheet.

A known printing apparatus includes a holding member, a pair of contact-type pressing members, and multiple attraction holes. The holding member is mounted on an outer circumferential surface of a rotary drum to hold and grip the leading end of a recording medium in a sheet conveying direction. The pair of contact-type pressing members includes pressing members disposed upstream from the holding member in the sheet conveying direction and provided at both ends of the outer circumferential surface of the rotary drum. The pair of contact-type pressing members presses the recording medium toward the rotary drum by contacting the lateral side end of the recording medium. The multiple attraction holes are formed in the outer circumferential surface of the rotary drum to attract the non-image forming face side of the recording medium to be conveyed.

SUMMARY

At least one aspect of this disclosure provides a sheet conveying device including a conveying body, a pressing body, and an attracting device. The conveying body conveys a sheet. The pressing body presses the sheet to a circumferential surface of the conveying body at an upstream side from an operation start position at which an operation with respect to the sheet starts, in a sheet conveying direction. The attracting device sucks and attracts the sheet onto the conveying body. The attracting device includes an attracting unit having an attracting region extending shorter than a distance between the pressing body and the operation start position. The attracting unit rotates together with the conveying body.

Further, at least one aspect of this disclosure provides an image forming apparatus including an image forming device to form an image on a sheet, and the above-described sheet conveying device to convey the sheet to the image forming device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
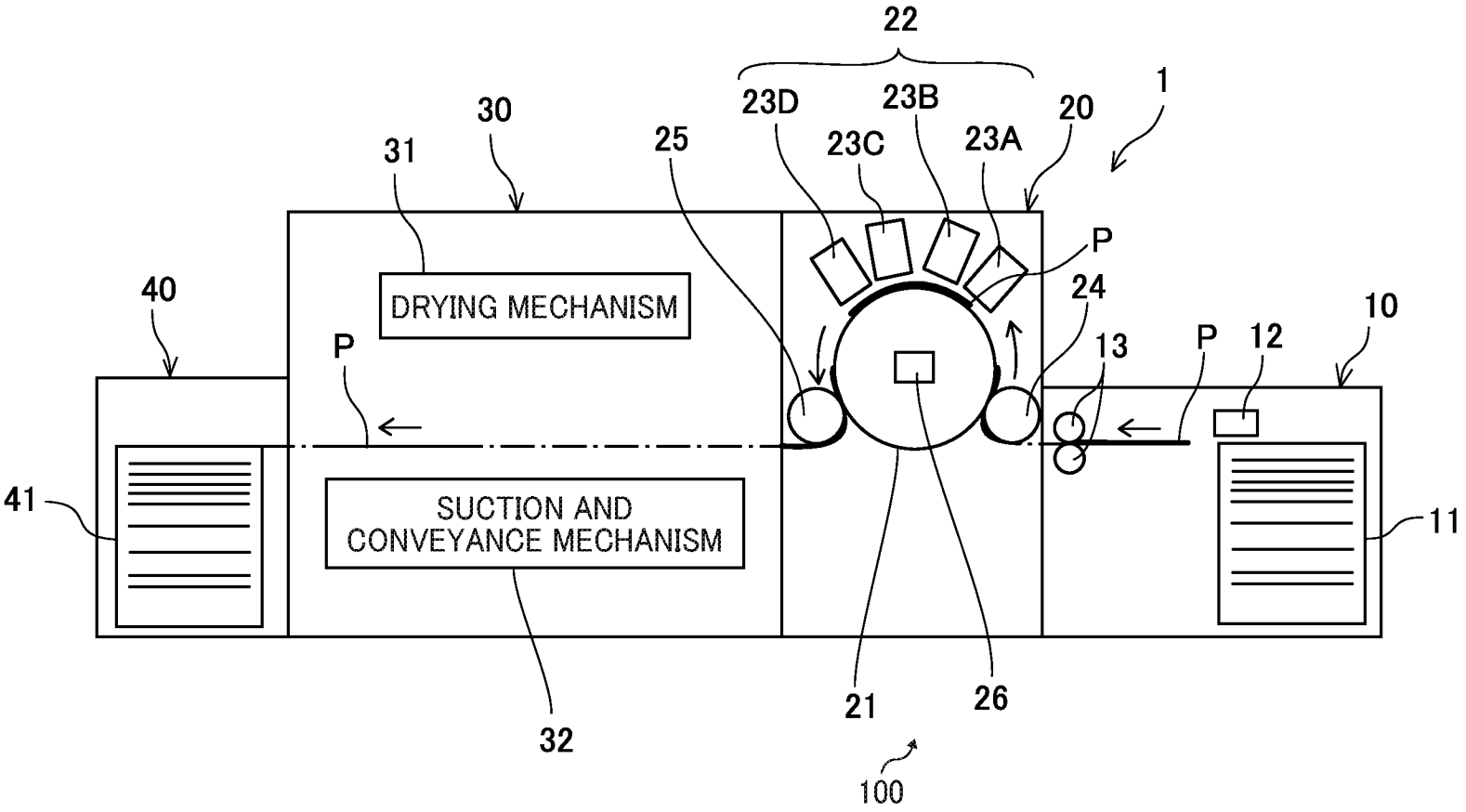
FIG. 1 is a schematic diagram illustrating an image forming apparatus (e.g., a printing apparatus) to discharge liquid, according to Embodiment 1 of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an inkjet image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a sheet conveying device and an image forming apparatus incorporating the sheet conveying device, with reference to the following figures.

It is to be noted that identical parts are given identical reference numerals and redundant descriptions are summarized or omitted accordingly.

A description is given of an image forming apparatus 1 according to Embodiment 1 of this disclosure, with reference to FIG. 1.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an inkjet image forming apparatus that forms images on recording media by discharging ink.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

FIG. 1 is a schematic diagram illustrating the image forming apparatus (e.g., a printing apparatus) to discharge liquid, according to Embodiment 1 of this disclosure.

The image forming apparatus 1 includes a sheet feeding device 10, a printing device 20, a drying device 30, and a sheet ejecting device 40. The image forming apparatus 1 feeds a sheet P that is fed from the sheet feeding device 10, prints an image on the sheet P by applying liquid in the printing device 20, dries the liquid adhered to the sheet P in the drying device 30, and ejects the sheet P to the sheet ejecting device 40.

The sheet feeding device 10 includes a sheet feed tray 11, a sheet feeding unit 12, and a pair of registration rollers 13. The sheet feed tray 11 loads multiple sheets P. The sheet feeding unit 12 separates the multiple sheets P fed from the sheet feed tray 11 one by one and feeds an uppermost sheet P of the multiple sheets P toward the printing device 20 that functions as an image forming device.

The sheet feeding unit 12 may be a sheet feeding unit that includes rollers, a sheet feeding unit employing an air suction method, and any other sheet feeding units. After the sheet P has been fed from the sheet feed tray 11 by the sheet feeding unit 12, as the leading end of the sheet P reaches the pair of registration rollers 13, the pair of registration rollers 13 drives and rotates at a predetermined timing to convey the sheet P to the printing device 20.

The printing device 20 includes a sheet conveying drum 21 and a liquid discharging device 22. The sheet conveying drum 21 functions as a conveying body to convey the sheet P while gripping the sheet P on an outer circumferential surface of the sheet conveying drum 21. The liquid discharging device 22 discharges liquid toward the sheet P that is borne on the sheet conveying drum 21.

The printing device 20 further includes a transfer cylinder 24 and a transfer cylinder 25. The transfer cylinder 24 receives the sheet P from the sheet feeding device 10 and transfers the sheet P to the sheet conveying drum 21. The transfer cylinder 25 receives the sheet P that is conveyed by the sheet conveying drum 21 and transfers the sheet P to the drying device 30.

After the sheet P has been conveyed from the sheet feeding device 10 to the printing device 20, the leading end of the sheet P is gripped b a sheet gripper that is mounted on the surface of the transfer cylinder 24, so that the sheet P is conveyed along with rotation of the transfer cylinder 24. The sheet P conveyed by the transfer cylinder 24 is transferred to the sheet conveying drum 21 at an opposing position where the sheet P is brought to face the sheet conveying drum 21.

Another sheet gripper is mounted on the surface of the sheet conveying drum 21, so that the leading end of the sheet P is gripped by the sheet gripper of the sheet conveying drum 21. Multiple suction holes are dispersedly formed in the surface of the sheet conveying drum 21. The printing device 20 further includes an attracting device 26 that functions as an attracting device and a liquid discharging device 22. The attracting device 26 generates suction airflow directed inward from the multiple suction holes of the sheet conveying drum 21.

After the sheet P is conveyed from the transfer cylinder 24 to the sheet conveying drum 21, the leading end of the sheet P is gripped by the sheet gripper of the sheet conveying drum 21 and, at the same time, the sheet P is attracted onto the sheet conveying drum 21 due to suction airflow generated by the attracting device 26. Accordingly, the sheet P is conveyed along with rotation of the sheet conveying drum 21. The sheet conveying drum 21, the attracting device 26, and a leveling roller 28 (described later) are included in a sheet conveying device 100.

The liquid discharging device 22 includes a liquid discharging unit 23 (to be more specific, liquid discharging units 23A, 23B, 23C, and 23D). For example, the liquid discharging unit 23A discharges liquid of cyan (C), the liquid discharging unit 23B discharges liquid of magenta (M), the liquid discharging unit 23C discharges liquid of yellow (Y), the liquid discharging unit 23D discharges liquid of black (K). It is to be noted that another liquid discharging unit that discharges liquid of special color such as white, gold, and silver or liquid such as surface coating liquid may be provided, according to a user's request.

Respective liquid discharging units 23A, 23B, 23C, and 23D of the liquid discharging device 22 are controlled by respective drive signals according to printing information. When the sheet P that is borne on the sheet conveying drum 21 passes an opposing region facing the liquid discharging device 22, liquid of respective colors (i.e., cyan, magenta, yellow, and black) is discharged from the liquid discharging unit 23 (i.e., the liquid discharging units 23A, 23B, 23C, and 23D), so that an image according to the printing information is formed.

The drying device 30 includes a drying mechanism 31 and a suction and conveyance mechanism 32. The drying mechanism 31 dries liquid that is adhered onto the sheet P in the printing device 20. The suction and conveyance mechanism 32 conveys the sheet P that is conveyed from the printing device 20 while sucking the sheet P (in other words, simultaneously performs suction and conveyance of the sheet P).

The sheet P that is conveyed from the printing device 20 is received by the suction and conveyance mechanism 32. Then, the sheet P is conveyed to pass through the drying mechanism 31 and is transferred to the sheet ejecting device 40.

When passing through the drying mechanism 31, the liquid on the sheet P is subjected to a drying operation performed by the drying mechanism 31. According to the drying operation by the drying mechanism 31, moisture such as water in the liquid evaporates. Consequently, the colorant contained in the liquid is fixed to the sheet P, and curling of the sheet P is restrained.

The sheet ejecting device 40 includes a sheet ejection tray 41 on which multiple sheets P are loaded. The sheets P that are sequentially conveyed from the drying device 30 are overlaid one after another on the sheet ejection tray 41 and stacked.

It is to be noted that the image forming apparatus 1 may include a pre-processing device that performs pre-processing to the sheet P and locate the pre-processing device upstream from the printing device 20 in the sheet conveying direction or include a post-processing device that performs post-processing to the sheet P and locate the post-processing device between the drying device 30 and the sheet ejecting device 40.

As an example of the pre-processing, for example, a pre-coating operation is performed to apply processing liquid to a sheet P in order to restrain bleeding of liquid reacting to the liquid. In addition, as an example of the post-processing, for example, a sheet reversing and conveying process to reverse a sheet printed in the printing device 20 and send the sheet again to the printing device 20 so as to print both sides of the sheet, and a binding process to bind multiple sheets.

Figure 2:
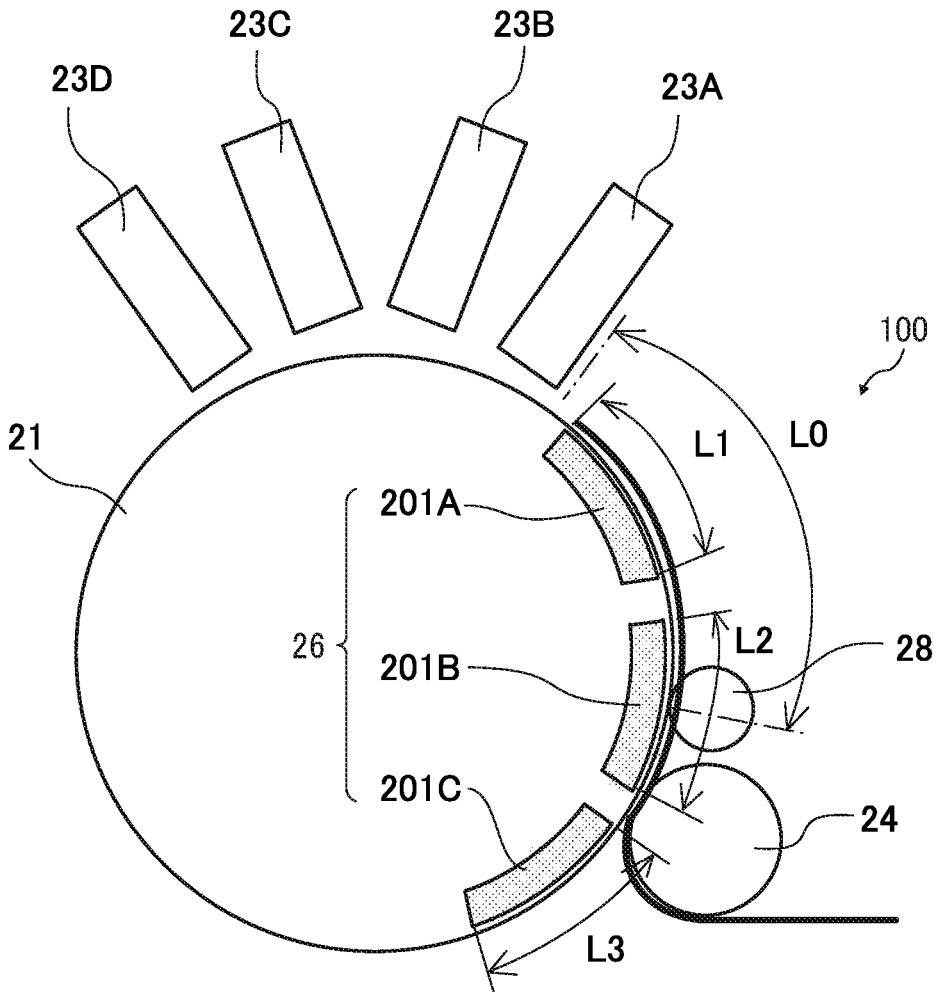
FIG. 2 is a schematic diagram illustrating a sheet conveying drum and components included in an attracting device.
Figure 3:
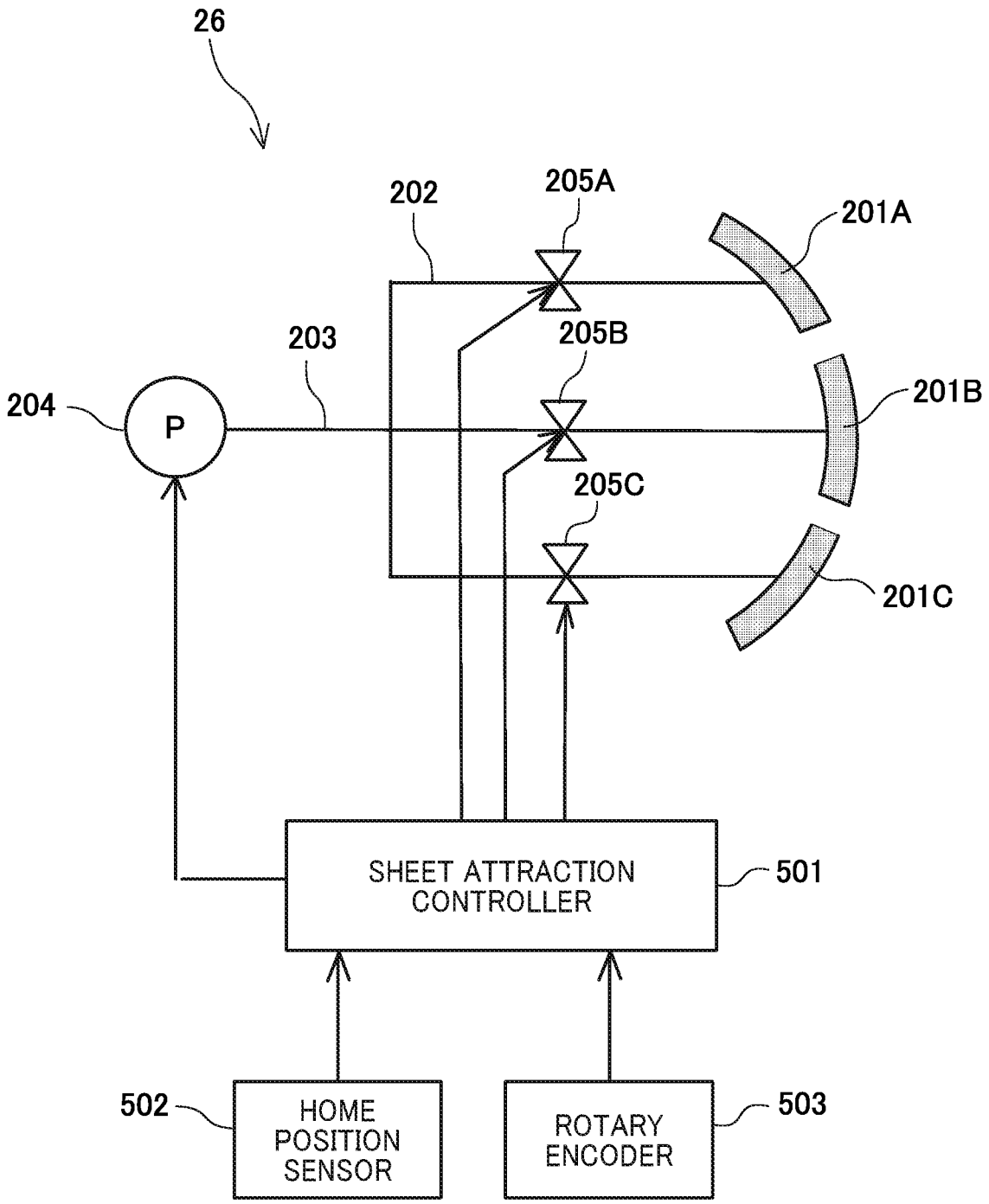
FIG. 3 is a diagram illustrating the configuration of the attracting device.

Next, a description is given of the attracting device 26, with reference to FIGS. 2 and 3.

FIG. 2 is a schematic diagram illustrating the sheet conveying drum 21 and components around the sheet conveying drum 21 included in the attracting device 26. FIG. 3 is a diagram illustrating the configuration of the attracting device 26 of FIG. 2.

First, referring to FIG. 2, a leveling roller 28 is disposed in the vicinity of the sheet conveying drum 21, upstream from the liquid discharging unit 23 (to be more specific, the liquid discharging unit 23A) in the sheet conveying direction, and downstream from the transfer cylinder 24 in the sheet conveying direction. The leveling roller 28 functions as a pressing body to press the sheet P to the outer circumferential surface of the sheet conveying drum 21. As previously described, the leveling roller 28 is included in the sheet conveying device 100.

Specifically, in the present embodiment, the printing device 20 performs a printing operation that is a predetermined operation to the sheet P, and an operation start position at which the printing operation (i.e., the predetermined operation) of the printing device 20 (hereinafter, referred to as a "printing operation start position") equals a liquid discharging position at which the liquid discharging unit 23A that is an extreme upstream side liquid discharging unit of the liquid discharging units 23A, 23B, 23C, and 23D discharges liquid.

By gripping the leading end of the sheet P by the sheet gripper of the sheet conveying drum 21 and pressing the trailing end of the sheet P by the leveling roller 28, a tension force is applied to the sheet P. As a result, crease and lifting of the sheet P are corrected, and therefore the sheet P is borne on the sheet conveying drum 21 along the outer circumferential surface of the sheet conveying drum 21.

An attracting unit (or a suction unit) 201 (i.e., attracting units 201A, 201B, and 201C) that forms the attracting device 26 is disposed inside the sheet conveying drum 21. The attracting unit 201 rotates in cooperation with rotation of the sheet conveying drum 21.

The attracting units 201A, 201B, and 201C include respective attraction regions (i.e., sucking regions) having respective lengths L1, L2, and L3 shorter or smaller than a distance L0 extending from the leveling roller 28 to the printing operation start position of the liquid discharging unit 23A as an extreme upstream liquid discharging unit. The relations of the lengths L1, L2, and L3 to the distance L0 are expressed as $L1<L0$, $L2<L0$, and $L3<L0$.

In the present embodiment, the sheet conveying drum 21 is capable of bearing multiple sheets P at the same time and includes the attracting units 201A, 201B, and 201C that are divided in three according to the length of a single sheet P. However, the configuration of the sheet conveying drum 21 is not limited to this configuration.

In the above-described configuration of the sheet conveying drum 21, the lengths of the respective attraction regions of the attracting units 201A, 201B, and 201C may not be equal to each other. For example, in consideration of the corresponding size of the sheet P, the length of the attraction region of the attracting unit 201 is adjusted to the smallest size, in other words, the minimum size. Therefore, the attracting unit that is disposed on the extreme downstream side in the sheet conveying direction (in this case, the attracting unit 201C) has the longest attraction region. Since the other attraction regions closer to the trailing end of the sheet P is determined according to division of the sheet P, the respective lengths of the other attraction regions are shorter than the length of attraction region of the extreme downstream side attracting unit.

However, the length of the attraction region of the attracting unit 201 on the extreme downstream side in the sheet conveying direction is shorter (smaller) than the distance extending from the leveling roller 28 (i.e., a pressing body) to the printing operation start position at which the liquid discharging unit 23A that is disposed on the extreme upstream side in the sheet conveying direction.

Next, referring to FIG. 3, the attracting device 26 further includes dedicated suction passages 202, a common suction passage 203, and a suction pump 204. The attracting unit 201 (i.e., the attracting units 201A, 201B, and 201C) of the attracting device 26 is coupled to the suction pump 204 that functions as a suction body, via the dedicated suction passages 202 and the common suction passage 203. The respective dedicated suction passages 202 are provided with each electromagnetic valve 205 (specifically, electromagnetic valves 205A, 205B, and 205C) that functions as an opening and closing body.

The attracting device 26 further includes an attraction controller 501 that performs control of driving of the suction pump 204 and control of opening and closing of the electromagnetic valve 205 (i.e., the electromagnetic valves 205A, 205B, and 205C).

The attraction controller 501 is connected to a home sensor 502 and a rotary encoder 503. The home sensor 502 outputs a home position signal according to rotation of the sheet conveying drum 21. The rotary encoder 503 obtains a count value of the output pulses. The attraction controller 501 detects the respective positions of the attracting units 201A, 201B, and 201C relative to the leveling roller 28 based on the home position signal of the home sensor 502 and the count value of the output pulses of the rotary encoder 503. Based on the result, the attraction controller 501 controls opening and closing of the electromagnetic valve 205 (i.e., the electromagnetic valves 205A, 205B, and 205C) to control attraction of the sheet P performed by the attracting unit 201 (i.e., the attracting units 201A, 201B, and 201C).

Figure 4:
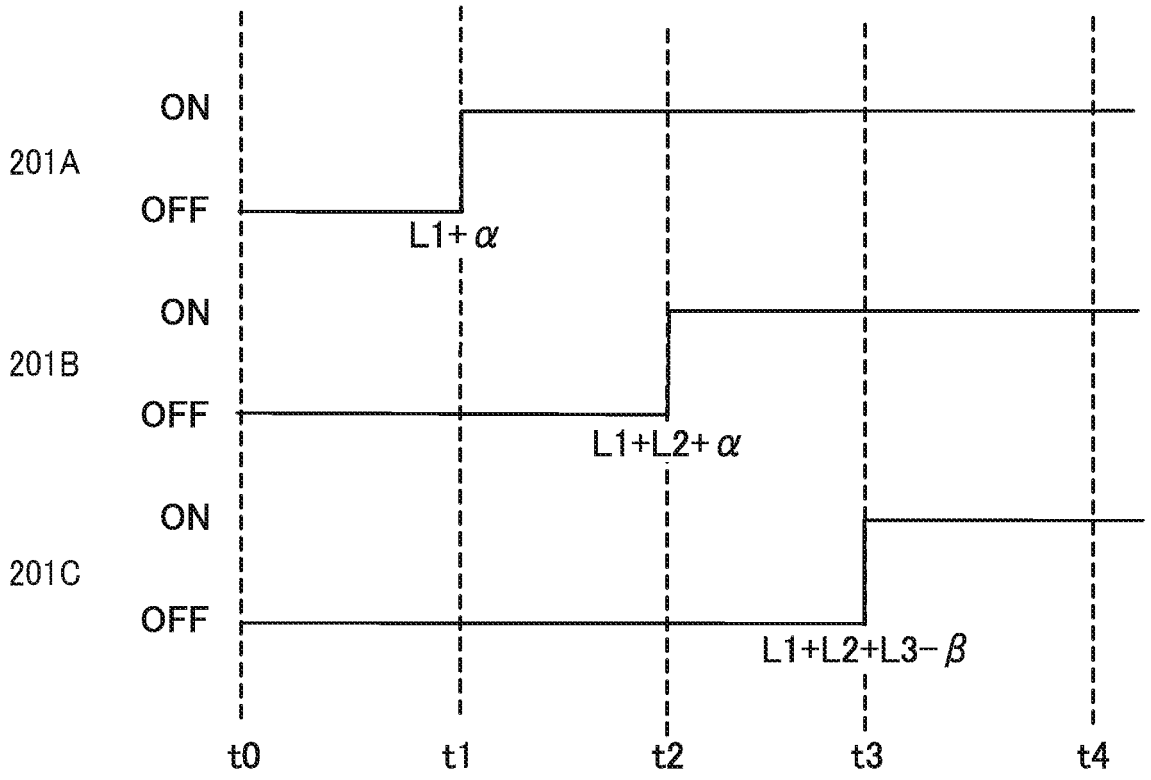
FIG. 4 is a diagram illustrating control of attraction timings of an attraction controller.

Next, a description is given of attraction control performed by the attraction controller 501, with reference to drawings including FIG. 4.

FIG. 4 is a diagram illustrating timings of attraction control of the attraction controller 501.

First, the transfer cylinder 24 conveys the sheet P to the sheet conveying drum 21. Then, the sheet gripper of the sheet conveying drum 21 grips the leading end of the sheet P, so that the sheet P is further conveyed along with rotation of the sheet conveying drum 21. Then, as the sheet P passes through the leveling roller 28, the sheet P receives a tension force. Accordingly, crease and lifting of the sheet P are corrected.

Here, for example, assuming that the leading end of the attracting unit 201A passes the leveling roller 28 at a point in time t0 as illustrated in the graph of FIG. 4, the attracting unit 201A continues to halt the start of attraction of the sheet P from the point in time t0.

Then, at a point in time t1 in the graph of FIG. 4 after the trailing end of the attracting unit 201A passes the leveling roller 28, for example, the electromagnetic valve 205A is opened and the attracting unit 201A starts to attract the sheet P onto the sheet conveying drum 21. In this case, the distance from the point in time t0 to the point in time t1 as illustrated in the graph of FIG. 4 equals to a distance of the sum of the length L1 of the attraction region of the attracting unit 201A and an amount of margin $\alpha$.

It is to be noted that this description is given without a time lag between the operation of the electromagnetic valve 205 and generation of an actual attracting force. However, when a time lag is generated, the electromagnetic valve 205 is opened earlier by the time lag.

Therefore, when the sheet P passes through the leveling roller 28 and is subjected to a tension force applied between the gripping at the leading end of the sheet P by the sheet gripper of the sheet conveying drum 21 and the leveling roller 28, the sheet P is not attracted to the sheet conveying drum 21. Accordingly, crease and lifting of the sheet P are corrected by the tension force.

By contrast, in a case in which the sheet P is attracted to the sheet conveying drum 21 when the sheet P has passed the leveling roller 28, a frictional force that is generated between the sheet P and the sheet conveying drum 21 increases. Therefore, crease and lifting of the sheet P are fixed when the sheet P is attracted. As a result, even if the tension force is applied by the leveling roller 28, the sheet P fails to be leveled.

Then, at a point in time t2 in the graph of FIG. 4 after the trailing end of the attracting unit 201B passes the leveling roller 28, for example, the electromagnetic valve 205B is opened and the attracting unit 201B starts attraction of the sheet P. In this case, the distance from the point in time t1 to the point in time t2 as illustrated in the graph of FIG. 4 equals to a distance of the sum of the length L1 of the attraction region of the attracting unit 201A, the length L2 of the attraction region of the attracting unit 201B, and the amount of margin $\alpha$.

Further, at a point in time t3 in the graph of FIG. 4 after the trailing end of the attracting unit 201C passes the leveling roller 28, for example, the electromagnetic valve 205C is opened and the attracting unit 201C starts attraction of the sheet P. In this case, the distance from the point in time t1 to the point in time t3 as illustrated in the graph of FIG. 4 equals to a distance of the total of the sum of the length L1 of the attraction region of the attracting unit 201A, the length L2 of the attraction region of the attracting unit 201B, and the length L3 of the attraction region of the attracting unit 201C, subtracted by an amount of margin $\beta$.

Here, the amount of margin $\beta$ is a length to be subtracted due to attraction of the attracting unit 201C performed before the trailing end of the sheet P passes the leveling roller 28.

Specifically, when the trailing end of the sheet P is being opposed to any part of the attracting unit 201, the trailing end of the sheet P comes out of the leveling roller 28 without being attracted before the attracting unit 201 passes the leveling roller 28. In a case in which the trailing end of the sheet P comes out of the leveling roller 28 without being attracted, it is likely that lifting of the sheet P occurs.

For example, in a comparative image forming apparatus, before a pair of contact-type pressing members presses a recording medium, an attracting member attracts the recording medium. As a result, the effect of leveling the recording medium onto the circumferential surface of a conveying drum by the pair of contact-type pressing members to restrain crease and lifting of the recording medium cannot be achieved sufficiently.

Therefore, in a case in which the trailing end of the sheet P is opposed to the attracting unit 201, even before the attracting unit 201 passes the leveling roller 28, the attracting unit 201 attracts the sheet P before the trailing end of the sheet P comes out of the leveling roller 28.

As described above, when the trailing end of the sheet P is opposed to any part of the attracting unit 201, the attracting device 26 causes the attracting unit 201 to attract the sheet P onto the sheet conveying drum 21 before the trailing end of the sheet P passes the leveling roller 28 (i.e., a pressing body).

Accordingly, the sheet P is prevented from lifting of the trailing end of the sheet P, and therefore is conveyed stably.

Further, for example, even when the trailing end of the sheet P is opposed to any part of the attracting unit 201B or when the sheet P corresponds to a sheet having the size to be opposed to the attracting unit 201A, it is preferable that the attracting unit 201 attracts the sheet P onto the sheet conveying drum 21 before the trailing end of the sheet P passes the leveling roller 28.

In other words, in a case in which the distance of attraction of the sheet P by the attracting unit 201 is shorter (smaller) than the distance L0 that is the distance between the leveling roller 28 (i.e., a pressing body) and the printing operation start position, the attracting device 26 causes the attracting unit 201 to attract the sheet P onto the sheet conveying drum 21 before the trailing end of the sheet P passes the leveling roller 28.

Accordingly, the sheet P is prevented from lifting of the sheet P, and therefore is conveyed stably.

Figure 5:
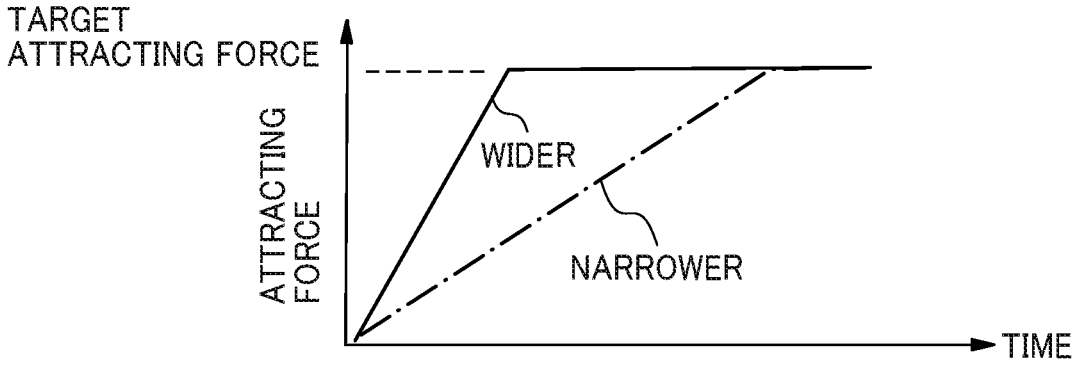
FIG. 5 is a diagram illustrating an example of relation of the size of a sheet in the width direction, attracting force, and time according to Embodiment 2 of this disclosure.

Next, a description is given of an image forming apparatus 1 according to Embodiment 2, with reference to drawings including FIG. 5.

FIG. 5 is a diagram illustrating an example of relation of the size of a sheet in the width direction, attracting force, and time according to Embodiment 2 of this disclosure.

In the present embodiment, the attracting device 26 changes the timing to apply the attracting force of the attracting unit 201 according to the width in a direction perpendicular to the sheet conveying direction of the sheet P.

To be more specific, the wider the width in the direction perpendicular to the sheet conveying direction of the sheet P is, the smaller the number of suction holes that are not blocked by the sheet P becomes, among the multiple suction holes of the sheet conveying drum 21. By contrast, the narrower the width in the direction perpendicular to the sheet conveying direction of the sheet P is, the greater the number of suction holes that are not blocked by the sheet P becomes.

Therefore, depending on the number of suction holes that not blocked by the sheet P, the time that is taken until the attracting force of the attracting unit 201 reaches a predetermined attracting force varies. For example, as illustrated in FIG. 5, the time from the start of the suction by the attracting unit 201 to the target attracting force takes longer (greater) in a case in which the width in the direction perpendicular to the sheet conveying direction of the sheet P is narrower with the smaller number of suction holes that are blocked by the sheet P than a case in which the width in the direction perpendicular to the sheet conveying direction of the sheet P is wider with the greater number of suction holes that are blocked by the sheet P.

Therefore, when the width of the sheet P is relatively wide, the timing of applying the attracting force (i.e., the timing of generating the suction force) is delayed, and when the width of the sheet material P is relatively narrow, the timing of applying the attracting force (i.e., the timing of generating the suction force) is made earlier. In this case, when a sheet having the largest applicable width (i.e., the maximum width applicable in the image forming apparatus 1) is conveyed, the timing of applying the attracting force to the sheet having the largest applicable width is the latest timing. Similarly, when a sheet having the smallest applicable width (i.e., the minimum width applicable in the image forming apparatus 1) is conveyed, the timing of applying the attracting force to the sheet having the smallest applicable width is the earliest timing.

Consequently, the sheet P is attracted stably.

For example, in the example of FIG. 4, when the electromagnetic valve 205A is opened and the attracting unit 201A attracts the sheet P at the point in time t1, the electromagnetic valve 205A is opened earlier when the attracting unit 201A attracts the sheet P having a narrower width than when the attracting unit 201A attracts the sheet P having a wider width. With this operation, the attracting unit 201A generates the target attracting force at the point in time t1.

It is to be noted that, in the present embodiment, the timing of applying the attracting force is controlled. However, the operation of the attracting device 26 is not limited thereto. For example, the suction force of the attracting unit 201 may also be changed according to the width of the sheet P.

The change of the suction force is achieved by changing the suction force of the suction pump 204 that functions as a suction body according to the width of the sheet P. According to this operation, the time until the attracting force of the attracting unit 201 reaches the target attracting force is substantially equal even though the width of the sheet P is relatively narrow or relatively wide.

It is to be noted that, each of the above-described embodiments provides an example in which the predetermined operation is a printing operation. However, the predetermined operation is not limited to the printing operation. For example, the predetermined operation may include a reading operation to read an image formed on a sheet and a detecting operation to detect a position detecting mark of a sheet and the leading end of a sheet.

In this disclosure, the term "liquid" that is used as liquid discharged from a liquid discharging unit includes any liquid having a viscosity or a surface tension that can be discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge apparatus" used herein is an apparatus including the liquid discharge head or the liquid discharge device to discharge liquid by driving the liquid discharge head. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material onto which liquid adheres" denotes, for example, a material or a medium onto which liquid is adhered at least temporarily, a material or a medium onto which liquid is adhered and fixed, or a material or a medium onto which liquid is adhered and into which the liquid permeates. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

The above-mentioned "material onto which liquid adheres" may be any material as long as liquid can temporarily adhere such as paper, thread, fiber, cloth, leather, metal, plastic, glass, wood, ceramics, or the like.

The "liquid discharge apparatus" may be an apparatus to relatively move the liquid discharge head and a material on which liquid can be adhered. However, the liquid discharge apparatus is not limited to such an apparatus. For example, the "liquid discharge apparatus" may be a serial head apparatus that moves the liquid discharge head, a line head apparatus that does not move the liquid discharge head, or the like.

Examples of the "liquid discharge apparatus" further include a treatment liquid coating apparatus to discharge the treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials. Further, there is an injection granulation apparatus for spraying a composition liquid in which raw materials are dispersed in a solution through a nozzle to granulate fine particles of the raw material.

The terms "image formation", "recording", "printing", "image printing", and "fabricating" used herein may be used synonymously with each other.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a conveying body configured to convey a sheet;

a pressing body configured to press the sheet to a circumferential surface of the conveying body at an upstream side from an operation start position at which an operation with respect to the sheet starts, in a sheet conveying direction; and an attracting device configured to suck and attract the sheet onto the conveying body, the attracting device including at least one attracting unit having at least one attracting region extending shorter than a distance between the pressing body and the operation start position, and the attracting device further including a controller, the controller configured to change a timing to generate an attracting force of the attracting unit based on a width of the sheet in a direction perpendicular to the sheet conveying direction; and the attracting unit is configured to rotate together with the conveying body.

2. The sheet conveying device according to claim 1, wherein, after the attracting region of the attracting unit passes the pressing body, the attracting device is further configured to attract the sheet onto the conveying body.

3. The sheet conveying device according to claim 1, wherein the attracting device includes a plurality of attracting units; and each attracting unit having the attracting region shorter than the distance between the pressing body and the operation start position.

4. The sheet conveying device according to claim 1, wherein, in response to a trailing end of the sheet being opposed to the attracting unit, the attracting device is further configured to cause the attracting unit to attract the sheet onto the conveying body before the trailing end of the sheet passes the pressing body.

5. The sheet conveying device according to claim 1, wherein, in response to a distance of attraction of the sheet being shorter than the distance between the pressing body and the operation start position, the attracting device is further configured to cause the attracting unit to attract the sheet onto the conveying body before the sheet passes the pressing body.

6. The sheet conveying device according to claim 1, wherein in response to the width of the sheet being a largest applicable width, the controller is further configured to change the timing to apply the attracting force of the attracting unit to a latest timing; and in response to the width of the sheet being a smallest applicable width, the controller is further configured to change the timing to apply the attracting force of the attracting unit to an earliest timing.

7. The sheet conveying device according to claim 1, wherein the controller is further configured to change a suction force of the attracting unit based on the width of the sheet in the direction perpendicular to the sheet conveying direction.

8. The sheet conveying device according to claim 1, wherein the operation is at least one of a printing operation, a reading operation, and a detecting operation, with respect to the sheet.

9. An image forming apparatus comprising:

an image forming device configured to form an image on a sheet; and the sheet conveying device according to claim 1 configured to convey the sheet to the image forming device.

10. The sheet conveying device according to claim 1, wherein the attracting device further includes a suction pump and at least one suction passage configured to provide fluidic communication between the suction pump and the attracting unit.

11. The sheet conveying device according to claim 1, wherein the attracting device further includes a controller, at least one electromagnetic valve, a home position sensor, and a rotary encoder; and the controller is configured to control the at least one electromagnetic valve based on readings from the home position sensor and the rotary encoder.

12. The sheet conveying device according to claim 11, wherein the controller is configured to determine a relative position of the at least one attracting unit relative to the pressing body.

13. The sheet conveying device according to claim 1, wherein the attracting device is further configured to change the timing to generate the attracting force of the attracting unit by opening or closing at least one electromagnetic valve based on the width of the sheet.

14. A method for operating a sheet conveying device comprising:

conveying a sheet using a conveying body;

pressing the sheet to a circumferential surface of the conveying body at an upstream side from an operation start position at which an operation with respect to the sheet starts, in a sheet conveying direction using a pressing body; and attracting the sheet onto the conveying body using an attracting device, the attracting the sheet onto the conveying body including changing a timing to generate an attracting force of at least one attracting unit based on a width of the sheet in a direction perpendicular to the sheet conveying direction.

15. The method according to claim 14, wherein the attracting device includes the at least one attracting unit; and the attracting the sheet onto the conveying body further includes attracting the sheet onto the conveying body after an attracting region of the at least one attracting unit passes the pressing body.

16. The method according to claim 14, wherein the attracting device includes a plurality of attracting units; and an attracting unit of the plurality of attracting units having an attracting region shorter than a distance between the pressing body and the operation start position is disposed on a downstream position of the conveying body in the sheet conveying direction.

17. The method according to claim 14, wherein, in response to a trailing end of the sheet being opposed to the at least one attracting unit, the method further includes attracting the sheet onto the conveying body before the trailing end of the sheet passes the pressing body.

18. The method according to claim 14, wherein, in response to a distance of attraction of the sheet being shorter than the distance between the pressing body and the operation start position, the method further includes attracting the sheet onto the conveying body before the sheet passes the pressing body.

19. The method according to claim 14, wherein in response to the width of the sheet being a largest applicable width, the method further includes changing the timing to apply the attracting force of the at least one attracting unit to a latest timing; and in response to the width of the sheet being a smallest applicable width, the method further includes changing the timing to apply the attracting force of the at least one attracting unit to an earliest timing.

20. The method according to claim 14, further comprising:

changing a suction force of the attracting unit based on the width of the sheet in the perpendicular direction to the sheet conveying direction.

* * * * *